US011232664B2

(12) United States Patent
Andersson et al.

(10) Patent No.: US 11,232,664 B2
(45) Date of Patent: Jan. 25, 2022

(54) DOOR ACCESS CONTROL

(71) Applicant: Axis AB, Lund (SE)

(72) Inventors: Daniel Andersson, Lund (SE); Ingemar Larsson, Lund (SE)

(73) Assignee: AXIS AB, Lund (SE)

( * ) Notice: Subject to any disclaimer, the term of this patent is extended or adjusted under 35 U.S.C. 154(b) by 0 days.

(21) Appl. No.: 17/231,013

(22) Filed: Apr. 15, 2021

(65) Prior Publication Data

US 2021/0366218 A1 Nov. 25, 2021

(30) Foreign Application Priority Data

May 25, 2020 (EP) ..... 20176225

(51) Int. Cl.
*G07C 9/27* (2020.01)

(52) U.S. Cl.
CPC ..... *G07C 9/27* (2020.01)

(58) Field of Classification Search
CPC ..... G07C 9/27
See application file for complete search history.

(56) References Cited

U.S. PATENT DOCUMENTS 10,089,801 B1 * 10/2018 Musabeyoglu .... G07C 9/00571
10,231,183 B2 3/2019 Kincaid et al.
10,453,281 B1 * 10/2019 Lopez ..... G07C 9/30
10,521,984 B1 * 12/2019 Johansson ..... G07C 9/00309
2006/0164205 A1 7/2006 Buckingham et al.
2015/0119019 A1 4/2015 Minichmayr
2016/0098874 A1 * 4/2016 Handville ..... G07C 9/00658 340/5.61
2018/0130276 A1 5/2018 Scoggins et al.
2019/0066415 A1 2/2019 Pang et al.
2019/0236869 A1 8/2019 Kazerani et al.

FOREIGN PATENT DOCUMENTS

WO 2019/048735 A1 3/2019

OTHER PUBLICATIONS

Niskanen, "Novelty Search Report", Uppdragshuset AB, Feb. 26, 2020, pp. 1-2.

* cited by examiner

*Primary Examiner* — Nabil H Syed
(74) *Attorney, Agent, or Firm* — Xsensus LLP

(57) ABSTRACT

The present application concerns access control for controlling unlocking of a door (102) at the presentation of credentials (108) at the door. A credentials relay unit (112) and a lock controller (114) are mounted in the vicinity of the door. The credentials relay unit transmits received credentials to a pre-configured, first network address, and in addition transmits a wake-up signal (122) to the lock controller, which upon receipt of the wake-up signal will transmit a request (126) for instructions to a pre-configured, second network address. In response to the request, the lock controller receives unlocking or no-action instructions (128*a*, 128*b*), and in case unlocking instructions are received, the lock controller transmits an unlocking signal (132).

13 Claims, 2 Drawing Sheets

DOOR ACCESS CONTROL

CROSS-REFERENCE TO RELATED APPLICATION

This application claims priority to European Patent Application No. 20176225.9, filed on May 25, 2020, the entire disclosure of which is incorporated by reference herein.

TECHNICAL FIELD

The present invention relates to the field of access control. In particular, the application relates to controlling unlocking of a door at the presentation of credentials at the door.

BACKGROUND

Access control systems for controlling unlocking of doors are used in many different locations, such as office premises, educational facilities and warehouses. There are several different variants available for how credentials can be presented at a door, how such credentials are checked for validity and how the door lock is controlled to be opened when presented credentials have been determined to be valid.

Some available solutions rely on a local door controller which keeps a list of credentials that are valid for unlocking the door. Such a door controller is mounted in the vicinity of the door(s) to be controlled and is connected to one or more doors and card readers. When an access card is presented to a card reader, the reader sends the relevant info of the access card to the door controller which checks if the access card credentials are valid for opening the door. If the credentials are listed as valid in the door controller, the door controller controls the door to unlock.

In addition, the local door controller may be connected to an access control server or can be reached directly via a software program over a network connection, in order to allow a security operator to keep the list of valid credentials up to date. Examples of such units are the network door controllers Axis A1001 and Axis A1601, delivered by Axis Communications AB.

While such existing solutions work well, there is still room for improvement.

SUMMARY OF THE INVENTION

An aim of the present invention is to provide an improved access control system which enables a remote check of credentials, thereby allowing use of less complex units closer to the door. Moreover, it is advantageous to provide an access control system which to a higher degree separates the receipt of credentials from the check of the validity of these credentials, in order to further improve tamper resistance and security.

According to a first aspect, these and other objects are achieved, in full or at least in part, by an access control system for controlling unlocking of a door at the presentation of credentials at the door, the access control system comprising a credentials relay unit and a lock controller which are mounted in the vicinity of the door, wherein the credentials relay unit comprises an input interface and a first network interface, wherein the credentials relay unit is configured to receive credentials via the input interface, and transmit credentials to a pre-configured, first remote network address via the first network interface, in response to receiving credentials via the input interface, wherein the credentials relay unit and the lock controller have a local communications interface, and the credentials relay unit is configured to transmit a wake-up signal to the lock controller via the local communications interface, in response to receiving credentials via the input interface, wherein the lock controller comprises a second network interface, and is configured to, in response to receiving the wake-up signal, transmit, via the second network interface, a request for instructions to a pre-configured, second remote network address and receive, via the second network interface, unlocking or no-action instructions, wherein the lock controller comprises a lock control interface and is configured to transmit a signal to unlock the door via the lock control interface, in response to receiving unlocking instructions via the second network interface.

By isolating the lock controlling function in a unit with limited capabilities, better tamper resistance is created and the access control system becomes more secure. The lock controller capabilities are limited in the sense that its communication with other units is trigger-based, meaning that communication from the lock controller is only initiated when the lock controller receives a signal to wake-up, or, in other words, is triggered by such a signal to send out the request for instructions. In addition, the fact that the communication is limited to being performed with the pre-configured, second network address further improves the security aspect. The lock controller has no open input communication interface that can be accessed in order to tamper the door lock. More importantly, the lock controller does not take any decisions on controlling the lock alone but acts solely upon access control commands (unlock/no-action) received via the second network interface in response to the request for instructions.

Worded differently, by moving the check of the validity of the credentials away from the edge. i.e., from the vicinity of the door, and by separating the receipt of credentials on the one hand, and the request and receipt of instructions to unlock on the other, in different units, i.e., the credentials relay unit and the lock controller, better tamper resistance is created and the system becomes more secure. Avoiding keeping data on access rights and credentials locally in the credentials relay unit or the lock controller also increases the security of the access control system.

Moreover, since the two units (lock controller and credentials relay unit) that are part of the access control system need only limited functionality, they can also be made inexpensive and power efficient. The units also have similar functions which enables them to have a similar, if not the same, structure. In fact, the two units may have the same construction but be configured for their respective task during installation. The first and second network address being pre-configured also makes the system easy to install and adds to the security by ensuring that there is no open IP-port on the lock controller or credentials relay unit through which tampering could be attempted.

The credentials relay unit may be configured to await an acknowledgement receipt of credentials sent via the first network interface, before transmitting the wake-up signal. In this way there will be no unnecessary wake-up signals sent to the lock controller from the credentials relay unit, which in turn means that there will be fewer or no unnecessarily sent requests for instructions from the lock controller. This is advantageous since it may save power in the lock controller, e.g., by avoiding activating the second network interface if not needed.

The local communications interface may be a low power, low bandwidth interface. This saves power in the credentials relay unit and the lock controller, which is especially advantageous in a situation where one or both of these are powered by batteries or other types of limited power supplies.

The lock controller may be configured to power up upon receipt of the wake-up signal, and power down after transmitting the signal to unlock the door, in order to reduce power consumption in the lock controller.

In particular, the lock controller may be configured to power up the second network interface upon receipt of the wake-up signal, and power down the second network interface after receiving the unlocking or no-action instructions. This is a convenient and easily implemented way of reducing power consumption in the lock controller.

At least one of the lock controller and the credentials relay unit may be powered by one or more of: a solar cell, a battery, and an energy harvesting unit. This simplifies installation of the access control system since there is no need to provide a power outlet when a power grid independent power source is employed.

The pre-configured first network address and the pre-configured second network address may point to a remote authorization server. The remote authorization server may be configured to compare received credentials to a group of access rights associated with credentials and determine if the received credentials are associated with access rights to unlock the door. This means that there is no need for providing this functionality in the credentials relay unit or in the lock controller, thereby reducing the functional requirement of those units.

The credentials relay unit may be connected to a credentials reader via the credentials input interface. The credentials relay unit and the credentials reader may be provided as separate physical units, or they may also be built into one and the same physical unit.

The credentials reader may comprise at least one of: a proximity reader, a smart card reader, a bar code reader, a magnetic reader, a biometric reader, and a keypad.

According to a second aspect, the above discussed and other objects are achieved, in full or at least in part, by a method of controlling unlocking of a door upon presentation of credentials at the door, comprising a credentials relay unit receiving the credentials, and transmitting the credentials to a pre-configured, first network address, the credentials relay unit transmitting a wake-up signal to a lock controller, the lock controller transmitting, in response to the wake-up signal, a request for instructions to a pre-configured, second network address, and receiving unlocking or no-action instructions from the pre-configured, second network address, the lock controller, upon receipt of unlocking instructions, transmitting a signal to unlock the door.

The above discussed embodiments and advantages discussed in connection to the first aspect applies to the second aspect as well.

A further scope of applicability of the present invention will become apparent from the detailed description given below. However, it should be understood that the detailed description and specific examples, while indicating preferred embodiments of the invention, are given by way of illustration only, since various changes and modifications within the scope of the invention will become apparent to those skilled in the art from this detailed description.

Hence, it is to be understood that this invention is not limited to the particular component parts of the system described or steps of the methods described as such system and method may vary. It is also to be understood that the terminology used herein is for purpose of describing particular embodiments only, and is not intended to be limiting. It must be noted that, as used in the specification and the appended claim, the articles "a", "an", "the", and "said" are intended to mean that there are one or more of the elements unless the context clearly dictates otherwise. Thus, for example, a reference to "a unit" or "the unit" may include several units, and the like. Furthermore, the word "comprising" does not exclude other elements or steps.

BRIEF DESCRIPTION OF THE DRAWINGS

The invention will now be described in more detail by way of example and with reference to the accompanying schematic drawings, in which.

DETAILED DESCRIPTION OF EMBODIMENTS

Figure 1:
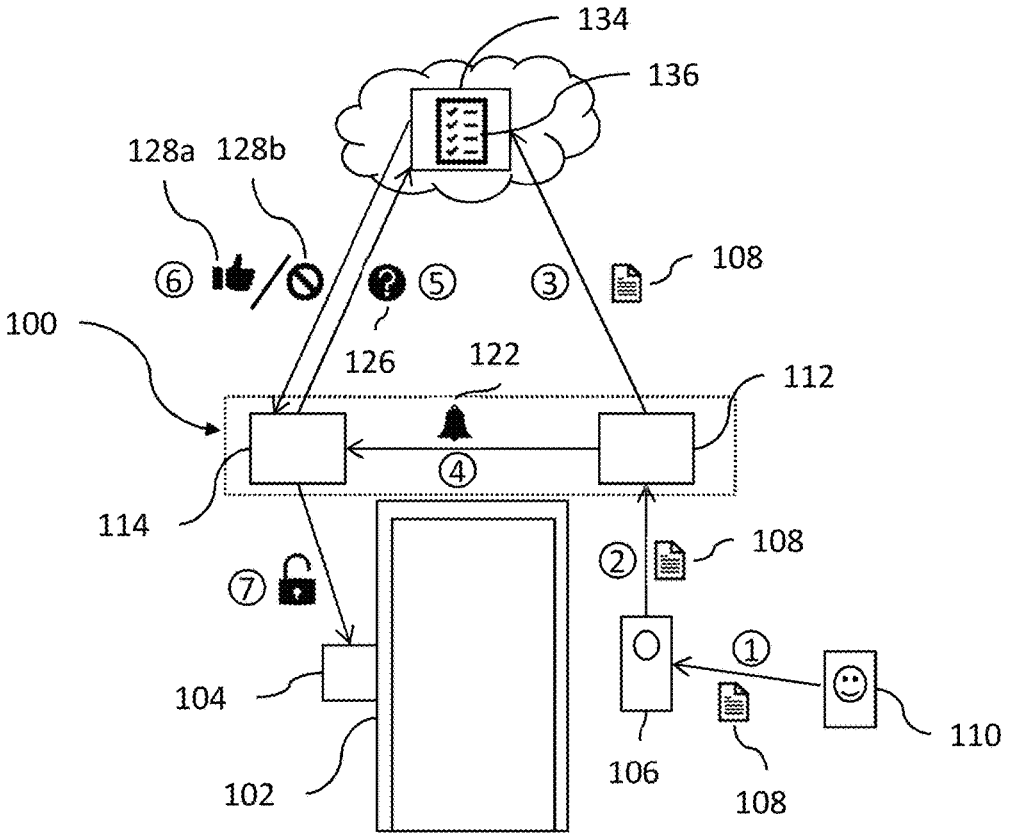
FIG. 1 illustrates an access control system arranged to control unlocking of a door.

FIG. 1 illustrates an access control system 100 which is mounted in the vicinity of a door 102 and is configured to control unlocking of a lock 104 at the door 102. A credentials reader 106 is mounted by the door. The credentials reader 106 reads credentials 108 presented to it. The credentials 108 can, e.g., be read from an access card 110, but many different alternatives exist.

In brief, the credentials reader may be any type of reader able to receive input credentials in a selected format. The credentials reader may also support a combination of different credentials input options. A common variant of such a combination would be a card reader with a keypad for inputting a numeric code. The credentials reader may include a proximity reader, such as in the form of an RFID reader, and the credentials may be presented via a card or some type of mobile device with an RFID, NFC or any other type of proximity based chip. The credentials reader may also be a smart card reader, and the credentials be presented via a smart card. The credentials reader may be magnetic reader, and the credentials may be presented via a magnetic strip card. The credentials reader may also be bar code reader, which is configured to read one or more types of barcode, including QR codes. The bar code may, e.g., be presented on a card, a piece of paper or on a display of mobile device. The credentials reader may also include some kind of biometric reader, which, e.g., can be in the form of a fingerprint reader, an eye, iris or retina scanner, a microphone, which may include sound or voice recognition capabilities, or a camera. The camera can include or be connected to another unit with analytics software or hardware for performing face recognition, gait recognition or recognition of any other biometric data which can be used as credentials. When a biometric reader is used, the credentials are normally in the form of one or more characteristic features of a person presenting themselves to the credentials reader.

Figure 2:
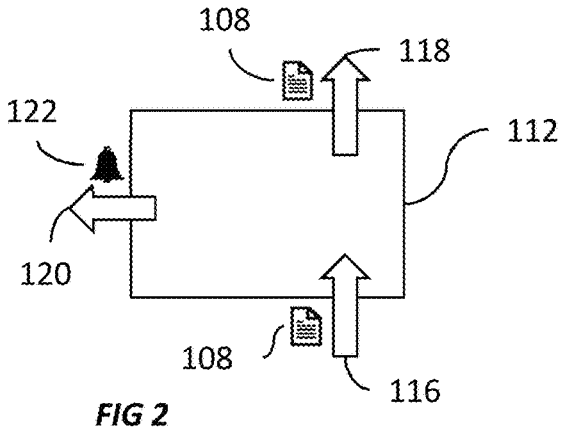
FIG. 2 illustrates a credentials relay unit.
Figure 3:
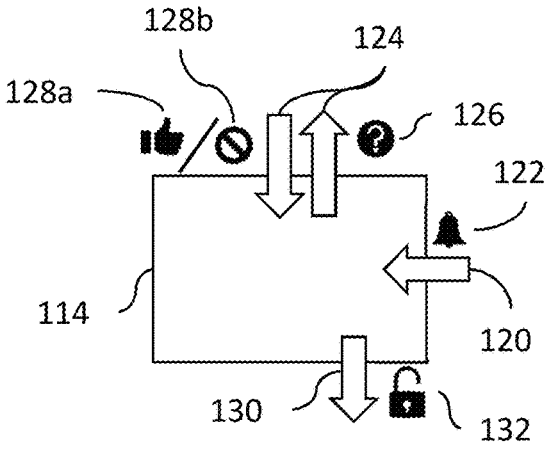
FIG. 3 illustrates a lock controller.

The access control system 100 includes a credentials relay unit 112 and a lock controller 114, which are illustrated in more detail in FIGS. 2 and 3, respectively. As shown in FIG. 2, the credentials relay unit 112 has an input interface 116, e.g., in the form of a standard Wiegand connection, where credentials 108 are received, and a first network interface 118, e.g., in the form of a wired or wireless LAN connection, or a cellular network connection, where the received credentials 108 are transmitted to a pre-configured, first remote network address.

The credentials relay unit 112 additionally has a local communication interface 120 connecting the credentials relay unit 112 to the lock controller 114. A wake-up signal 122 can be sent from the credentials relay unit 112 to the lock controller 114 via the local communication interface 120. The wakeup signal 122 could also be denoted trigger signal, or just trigger.

The local communications interface 120 is typically a low-power, low-bandwidth interface, and a common choice would be to use some type of interface employed in mesh networks, e.g., Zigbee or Z-wave. However, any type of connection suitable for the purpose of transferring the wake-up signal 122 may be used, be it wired or wireless. Some examples include communication via Bluetooth, BLE (Bluetooth Low Energy), IR (infrared light), VLC (visual light communication), audio/sound or ultrasonic communication, or electric pulses communicated via a wired interface. It would also be possible to mount the credentials relay unit 112 and the lock controller 114 within one and the same unit or housing. Typically, in such a case, a wired interface based on electric pulses could be used.

The lock controller 114 has a second network interface 124, e.g., in the form of a wired or wireless LAN connection, or a connection to a cellular network, where a request 126 for instructions is transmitted to a pre-configured, second remote network address, and where unlocking instructions 128*a*, or no-action instructions 128*b* are received. In addition, the lock controller 114 has a lock control interface 130, typically an electric wire, where a signal 132 to unlock the lock 104 at the door 102 is transmitted.

The credentials relay unit 112 or the lock controller 114, or both of them, are commonly powered by some kind of power source independent of the power grid, in order to simplify their installation. Batteries, solar cells or some kind of energy harvesting units are all examples of power sources that can be used to power one or both of the credentials relay unit 112 and the lock controller 114. Alternatively, one or both of these two units may be connected to a regular power outlet or be powered via Power over Ethernet (PoE), if deemed appropriate in a specific installation. If PoE is used, the first and second network connection may be Ethernet connections that are used for power supply via PoE as well.

In many cases, at least the lock controller 114, and possibly also the credentials relay unit 112, will be configured to be in a sleep mode when no input is received. The sleep mode may also be denoted idle mode or power-down mode. The term state may be used instead of mode. The lock controller 114 will typically be configured to wake from this sleep mode at the receipt of the wake-up signal 122. The credentials relay unit 112 may be configured to wake up at the receipt of the credentials 108. The use of a sleep mode will save power and extend the life of any limited power sources. The sleep mode can, e.g., imply that the first or the second network connection is powered down, e.g., by suspending any activity related to wireless operation, such as powering down a Wi-Fi module used for providing a wireless network connection for the first or second network interface, respectively. Other power retention and shut-down schemes may also be contemplated as long as power is preserved while still allowing receipt of the wake-up signal at the lock controller, and the credentials at the credentials relay unit.

Returning to FIG. 1, a typical situation where the access control system is used will now be explained. To start with, credentials 108 are presented to the credentials reader 106, e.g., in the form of an access card 110. This first step is symbolized in FIG. 1 by the encircled numeral 1. The credentials 108 are then transmitted to the credentials relay unit 112 via the input interface 116, as is shown at the numeral 2 in FIG. 1.

In response to receiving the credentials 108, the credentials relay unit 112 transmits the credentials 108 via the first network interface 118 to a preconfigured, first remote network address, which in some manner points to a remote authorization server 134. This step is shown at the numeral 3 in FIG. 1. The connection to the remote authorization server 134 may, e.g., be setup via some kind of gateway, e.g., using the O3C protocol. The remote authorization server 134 may, e.g., be a cloud based server.

The remote authorization server 134 contains a group or list of access rights to different doors or groups of doors, associated with various credentials, or, in other words, a database or table 136 connecting access rights to credentials. The remote authorization server 134 may optionally acknowledge receipt by transmitting an acknowledgement message to the credentials relay unit 112 in response to receiving the credentials 108.

Additionally, in response to receiving the credentials 108, the credentials relay unit 112 transmits a wake-up signal 122 via the local communications interface 120 to the lock controller 114. This step is denoted by the numeral 4 in FIG. 1. It would be possible to additionally await the optional acknowledgement message, or some other information, from the remote authorization server 134, before sending the wake-up signal 122 to the lock controller 114. In case acknowledgement messages are implemented, the credentials relay unit 112 would typically attempt a resend of the credentials 108 after a certain time has lapsed, in the absence of an acknowledgement message from the remote authorization server 134.

At the receipt of the wake-up signal 122, the lock controller 114 will send a request 126 for instructions to a pre-configured, second remote network address, via the second network interface 124. This second remote network address also points in some manner to the remote authorization server 134, in the same manner as the first remote network address. The first and the second remote network address may, e.g., be identical. This step is denoted by the numeral 5 in FIG. 1.

The remote authorization server 134 will check if the credentials 108, previously received from the credentials relay unit 112, are valid for unlocking the door 102, by accessing the table 136. This check may also have been performed at the receipt of the credentials 108 from the credentials relay unit 112.

As would be apparent to a person skilled in the art, there may be several other checks implemented, such as checking that the credentials 108 were received from the same door as the door for which the lock controller 114 is requesting instructions. Some kind of metadata may be used to tag the credentials 108 with information on which credentials reader 106 they were received from, i.e., to which door 102 the bearer of the credentials 108 is requesting access. The tagging may typically be performed in the credentials reader 106 or in the credentials relay unit 112. Various timers may also be implemented to make sure that there is a reasonably long time span, and no undue delay between the receipt of the credentials 108 and the request 126 for instructions at the remote authorization server 134. A too short time span or a too long delay could imply that the last received credentials 108 are unrelated to the current request 126 for instructions due to, e.g., some kind of network error or tampering attempt.

In case the credentials 108 are deemed valid, instructions 128*a* to unlock the lock 104 on the door 103 are sent back to the lock controller 114 via the second network interface 124, as is denoted by the numeral 6 in FIG. 1. In case the credentials 108 are not deemed to be valid, no-action instructions 128*b* are sent instead. It might be noted that if no instructions to unlock are received, the lock controller will not unlock the door, regardless of whether no-action instructions have been received or not. Hence, the lock controller will not unlock the lock 104 on the door 103 unless an active decision to unlock is taken and instructions to that effect are received by the lock controller 114.

When the lock controller 114 receives unlocking instructions 128*a*, it will proceed to control the lock 104 to unlock. To this end, an unlocking signal 132 is sent to the lock 104 via the lock control interface 130. This will cause the lock 104 to unlock, and the door 102 can now be opened. In case no-action instructions 128*b* are received, typically nothing more will happen, and the lock controller 114 might, e.g., power down into sleep mode after a set time.

As the skilled person would realize, it would also be possible to implement additional information flows involving the access control system, e.g., for allowing the credentials reader 106 to receive information that the lock 104 is unlocked, or that no valid credentials have been presented, such that this information may be shown on the credentials reader 106, in order to provide a notification to the person waiting to be let in. There are various ways to implement this provision of information, such as directly from the door lock 104 to the credentials reader 106, via the lock controller 114 and the credentials relay unit 112, or even involving the remote authorization server 134. Since this provision of information is not related to the present invention, further details will be omitted.

Figure 4:
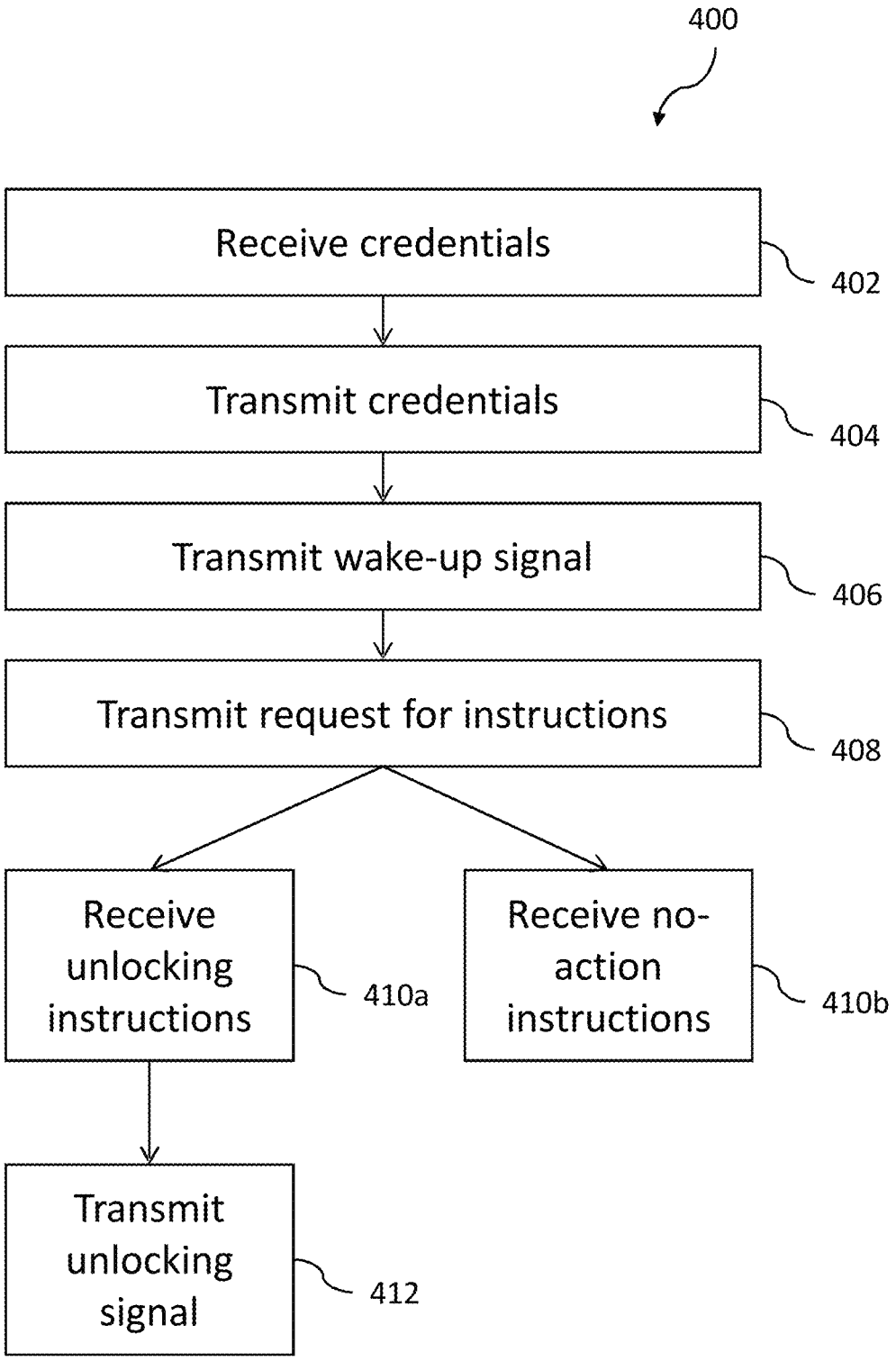
FIG. 4 is a flow chart illustrating an access control method.

In FIG. 4, a flow chart illustrating a method 400 involving the access control system 100 is shown. In step 402, credentials are received at the credentials relay unit. In step 404, these credentials are transmitted to the preconfigured, first network address. In step 406, the wake-up signal is sent from the credentials relay unit to the lock controller, and in step 408 the lock controller transmits the request for instructions to the pre-configured, second network address. In the next step, the lock controller receives either unlocking instructions in step 410*b*, or no-action instructions in step 410*b*. In case unlocking instructions are received, the next step 412 is that the lock controller transmits the unlocking signal. In case no-action instructions are received, no unlocking, or other signal is sent. In case the lock controller is set up with a sleep mode, this mode may be initiated at the receipt of such no-action instructions. The process from receiving credentials at the credentials relay unit to receiving unlocking instructions or no-action instructions at the lock controller takes at most 3-5 seconds, typically much less.

In summary, the present application concerns access control for controlling unlocking of a door at the presentation of credentials at the door. A credentials relay unit and a lock controller are mounted in the vicinity of the door. The credentials relay unit transmits received credentials to a pre-configured first network address, and in addition transmits a wake-up signal to the lock controller, which upon receipt of the wake-up signal transmit a request for instructions to a pre-configured, second network address. In response to the request, the lock controller receives unlocking or no-action instructions, and in case unlocking instructions are received, the lock controller transmits an unlocking signal.

The person skilled in the art realizes that the present invention by no means is limited to the preferred embodiments described above. On the contrary, many modifications and variations are possible within the scope of the appended claims. For example, acknowledgement messages or signals may be implemented at various nodes in the access control systems and its connecting units, according to principles well known in the field. In addition, the access control system may also be configured to have a fallback process for when the connections to the authorization server is lost. At such times, the credentials relay unit might be configured to send the credentials to the lock controller, and the lock controller might then make an independent decision to unlock, e.g., based on that the credentials have been deemed valid by the server recently, and therefore most likely are still valid. Such a fallback solution would also require the lock controller to keep a list of recently used and valid credentials.

| Reference numerals | |
|---|---|
| 100 | Access control system |
| 102 | Door |
| 104 | Lock |
| 106 | Credentials reader |
| 108 | Credentials |
| 110 | Access card |
| 112 | Credentials relay unit |
| 114 | Lock controller |
| 116 | Input interface |
| 118 | First network interface |
| 120 | Local communication interface |
| 122 | Wake-up signal |
| 124 | Second network interface |
| 126 | Request for instructions |
| 128a/128b | Unlocking/No-action instructions |
| 130 | Lock control interface |
| 132 | Unlocking signal |
| 134 | Remote authorization server |
| 136 | Access rights & credentials table |

The invention claimed is:

1. An access control system for controlling unlocking of a door at the presentation of credentials at the door, the access control system comprising a credentials relay unit and a lock controller which are mounted in the vicinity of the door, wherein the credentials relay unit comprises an input interface and a first network interface, wherein the credentials relay unit is configured to receive credentials via the input interface, and transmit the credentials to a pre-configured, first remote network address via the first network interface, in response to receiving the credentials via the input interface, wherein the credentials relay unit and the lock controller have a local communications interface, and the credentials relay unit is configured to transmit a wake-up signal to the lock controller via the local communications interface, in response to receiving the credentials via the input interface, and wherein the credentials relay unit is configured to not transmit credentials or unlocking instructions to the lock controller, wherein the lock controller comprises a second network interface, and is configured to, in response to receiving the wake-up signal, transmit, via the second network interface, a request for instructions to a pre-configured, second remote network address and receive, via the second network interface, unlocking or no-action instructions, wherein the lock controller comprises a lock control interface and is configured to transmit a signal to unlock the door via the lock control interface, in response to receiving unlocking instructions via the second network interface, wherein the system further comprises a remote authorization server, and wherein the pre-configured first network address and the pre-configured second network address point to the remote authorization server.

2. The access control system of claim 1, wherein the credentials relay unit is configured to await an acknowledgement receipt of the credentials sent via the first network interface, before transmitting the wake-up signal.

3. The access control system of claim 1, wherein the local communications interface is a low power, low bandwidth interface.

4. The access control system claim 1, therein the lock controller is configured to power up upon receipt of the wake-up signal, and power down after transmitting the signal to unlock the door.

5. The access control system of claim 4, wherein the lock controller is configured to power up the second network interface upon receipt of the wake-up signal, and power down the second network interface after receiving the unlocking or no-action instructions.

6. The access control system of claim 1, wherein at least one of the lock controller and the credentials relay unit is powered by one or more of: a solar cell, a battery, and an energy harvesting unit.

7. The access control system of claim 1, wherein the remote authorization server is configured to compare received credentials to a group of access rights associated with the credentials and determine if the received credentials are associated with access rights to unlock the door.

8. The access control system of claim 1, wherein the credentials relay unit is connected to a credentials reader via the credentials input interface.

9. The access control system of claim 8, wherein the credentials reader comprises at least one of: a proximity reader, a smart card reader, a bar code reader, a magnetic reader, a biometric reader, and a keypad.

10. A method of controlling unlocking of a door upon presentation of credentials at the door, the method comprising:

a credentials relay unit receiving the credentials, and transmitting the credentials to a pre-configured, first network address, the credentials relay unit transmitting a wake-up signal to a lock controller, without transmitting the credentials or unlocking instructions to the lock controller, the lock controller transmitting, in response to the wake-up signal, a request for instructions to a pre-configured, second network address, and receiving unlocking or no-action instructions from the second network address, the lock controller, upon receipt of unlocking instructions, transmitting a signal to unlock the door, wherein the pre-configured first network address and the pre-configured second network address point to a remote authorization server.

11. The method of claim 10, further comprising the credentials relay unit awaiting an acknowledgement receipt of the credentials sent to the pre-configured, first network address before transmitting the wake-up signal.

12. The method of claim 10, further comprising:

the lock controller powering up upon receipt of the wake-up signal, and powering down after transmitting the signal to unlock the door.

13. The method of claim 10, further comprising comparing, by the remote authorization server, the transmitted credentials to a group of access rights associated with the credentials and determining if the credentials are associated with access rights to unlock the door.

* * * * *